US006848384B2

(12) United States Patent
Higgins et al.

(10) Patent No.: US 6,848,384 B2
(45) Date of Patent: Feb. 1, 2005

(54) KNUCKLE

(76) Inventors: John Andrew Higgins, 27 Harwood Street, Hamilton (NZ); Michael John Heap, Unit E, 10 Parkhead Place, Albany, Auckland (NZ); James Nelson Hodder, 302 Walkawa Road, Picton (NZ)

( * ) Notice: Subject to any disclaimer, the term of this patent is extended or adjusted under 35 U.S.C. 154(b) by 0 days.

(21) Appl. No.: 10/386,431

(22) Filed: Mar. 13, 2003

(65) Prior Publication Data

US 2004/0177796 A1 Sep. 16, 2004

(30) Foreign Application Priority Data

Mar. 13, 2002 (NZ) ..... 517766

(51) Int. Cl.[7] ..... B63B 59/06
(52) U.S. Cl. ..... 114/222; 15/144.1; 285/184; 285/185
(58) Field of Search ..... 114/222; 15/144.1; 285/184, 185

(56) References Cited

U.S. PATENT DOCUMENTS 4,717,180 A * 1/1988 Roman ..... 285/148.19
6,263,821 B1 * 7/2001 Hodder ..... 114/222
6,336,764 B1 * 1/2002 Liu ..... 401/289
6,540,163 B1 * 4/2003 Huang ..... 239/587.5

* cited by examiner

*Primary Examiner*—Sherman Basinger
(74) *Attorney, Agent, or Firm*—O.M. (Sam) Zaghmout; Bio Intellectual property Services (Bio IPS) LLC

(57) ABSTRACT

A boat hull cleaner having a handle (not shown) and a knuckle (see FIG. 1), the knuckle 1 having a first portion 2 and a second portion 3, the first portion 2 having a first channel and the second portion 3 having a second channel, the first portion 2 having a first connector part 4 to be joined to a first tubular part of the handle, and the second portion 3 having a second connector part 5 joined to a second tubular part of the handle;

the arrangement being such that a fluid can be caused to flow within the first tubular part of the handle, into the first and second channels of the knuckle 1, and then into the second tubular part of the handle, and wherein the first and second portions 2 and 3 of the knuckle 1 can be adjusted with respect to one another such that the first and second tubular parts of the handle assume an angle with respect to one another.

6 Claims, 8 Drawing Sheets

KNUCKLE

FIELD OF INVENTION

This invention relates to a knuckle. A particularly preferred form of the invention relates to a knuckle for use as part of a boat hull cleaner.

BACKGROUND

In the context of boating it is desirable to be able to clean the hull of a boat while standing on another boat, or on a pier, etc. Published U.S. Pat. specification No. 6,263,821 to Hodder (incorporated herein by way of reference) describes a boat hull cleaner designed specifically to meet this goal. In general terms, the hull cleaner includes a handle in the form of a pole, and a cleaning head (eg a brush or scourer, etc). The pole has a joint in its mid section so that it can be set at an angle and maintained there to facilitate the hull cleaning process. A further joint is arranged at the end of the pole to enable the pole to assume an adjustable angle with respect to the cleaning head. One embodiment of the present invention provides a knuckle suitable for use as at least one of these pole joints.

The term "comprise", "comprises", "comprising", or "comprised", if and when used in this document, should be interpreted non-exclusively—ie to convey "consisting of or including".

SUMMARY OF THE INVENTION

According to one aspect of the invention there is provided a boat hull cleaner having a handle and a knuckle, the knuckle having a first portion and a second portion, the first portion having a first channel and the second portion having a second channel, the first portion having a first connector part joined to a first tubular part of the handle, and the second portion having a second connector part joined to a second tubular part of the handle;

the arrangement being such that a fluid can be caused to flow within the first tubular part of the handle, into the first and second channels of the knuckle, and then into the second tubular part of the handle, and wherein the first and second portions of the knuckle can be adjusted with respect to one another such that the first and second tubular parts of the handle assume an angle with respect to one another.

Optionally the first connector part forms at least part of a pipe-like arm for receiving the first tubular part of the handle, and/or the second connector part forms at least part of a further pipe like arm for receiving the second tubular part of the handle.

Optionally the first portion of the knuckle is rotatable with respect to the second portion of the knuckle. The first and second portions of the knuckle may each have teeth which can engage one another.

Optionally at least one of the first and second portions of the knuckle has seal means, eg an o-ring arrangement, to prevent undesired leakage of fluid from within the knuckle when the knuckle is in use with fluid flowing therethrough.

Optionally the knuckle has a bolt which can be tightened to set the first and second connector parts at an angle with respect to one another, and then subsequently loosened to enable adjustment of the angle.

Optionally the boat hull cleaner set out above has a second knuckle at an end of the second tubular part of the handle remote from the first mentioned knuckle, the second knuckle arranged such that when it is in use fluid can flow from within the second tubular part of the handle to and through the second knuckle, into a cleaning head of the hull cleaner, and then exits the cleaning head.

Optionally the cleaning head incorporates at least one of a brush, a scourer, and a scraper.

Optionally the second knuckle is angle adjustable to provide for angular adjustment between the second tubular part of the handle and the cleaning head.

According to a further aspect of the invention there is provided a knuckle having a first portion and a second portion, the first portion having a first channel and the second portion having a second channel, the first portion having a first connector part and the second portion having a second connector part;

the knuckle being formed such that when it is in use a first length of tube can be secured to the first connector part and a second length of tube can be secured to the second connector part, the arrangement being such that a fluid can be caused to flow from the first length of tube into the first and second channels, and then into the second length of tube, and wherein the first and second portions can be adjusted with respect to one another such that the first and second lengths of tube assume an angle with respect to one another.

DESCRIPTION OF THE DRAWINGS

Some preferred aspects of the invention will now be described by way of example, and with reference to the accompanying drawings, of which.

DETAILED DESCRIPTION

Figure 1:
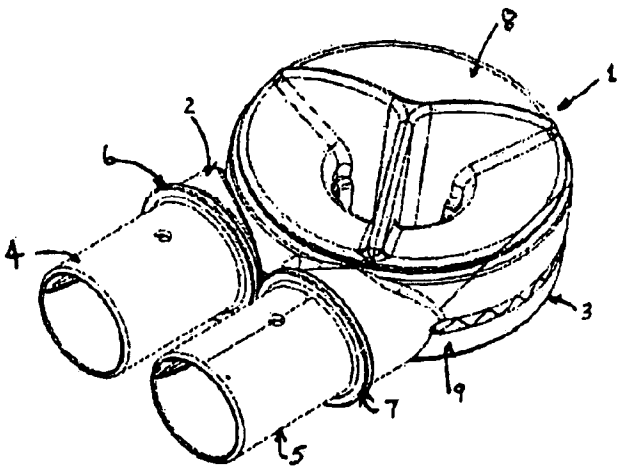
FIG. 1 is a perspective view of a zinc die-cast knuckle for use as part of a mid-handle section of a boat hull cleaner.

Referring to FIG. 1, the die cast knuckle 1 has a first portion 2 and a second portion 3.

The first portion has a tubular first arm 4 and the second portion has a tubular second arm 5. A first length of handle tubing (not shown) can be fitted as a sleeve around the first arm 4, and a second length of handle tubing (not shown) can be fitted as a sleeve around the second arm 5. The extent of such fitting is restricted by rims 6 and 7 on the first and second arms 4 and 5 respectively. The arrangement is such that the first length of handle tubing (not shown) fitted around the first arm 4 can carry a flow of water into the first arm 4 and thus into the knuckle. The water can then pass through the knuckle, exiting by way of the second arm 5, and move into the second length of handle tubing handle (not shown) fitted around the second arm 5. When the knuckle is used as part of a boat hull cleaner similar to that described in U.S. Pat. No. 6,263,821, the first and second lengths of handle tubing (not shown) which fit as sleeves around the arms 4 and 5 respectively form part of a handle of the hull cleaner. A flow of water can thus be introduced into an upper part of the handle, can flow therein to and through the knuckle, and into a lower part of the handle, and can then flow therein to and from a cleaning head (eg a brush or scourer, etc).

With further reference to FIG. 1, the first portion 2 of the knuckle can rotate with respect to the second portion 3 of the knuckle so that the angle between the first and second arms 4 and 5 can be adjusted. When the desired angle has been reached a central bolt 8 is turned by hand to lock the arms 4 and 5 in place. The bolt 8 can be subsequently loosened and the angle adjusted as desired. In this way the first and second arms 4 and 5 can be set at various angles between at least 0 and 230 degrees. With further reference to FIG. 1, each of the first and second portions 2 and 3 of the knuckle have teeth 9 for engaging one another to assist in setting the arms 4 and 5 at the desired angle. It will of-course be appreciated that the bolt 8 can be released sufficiently to enable the teeth 9 to disengage before the angle between the arms 4 and 5 is adjusted.

Figure 2:
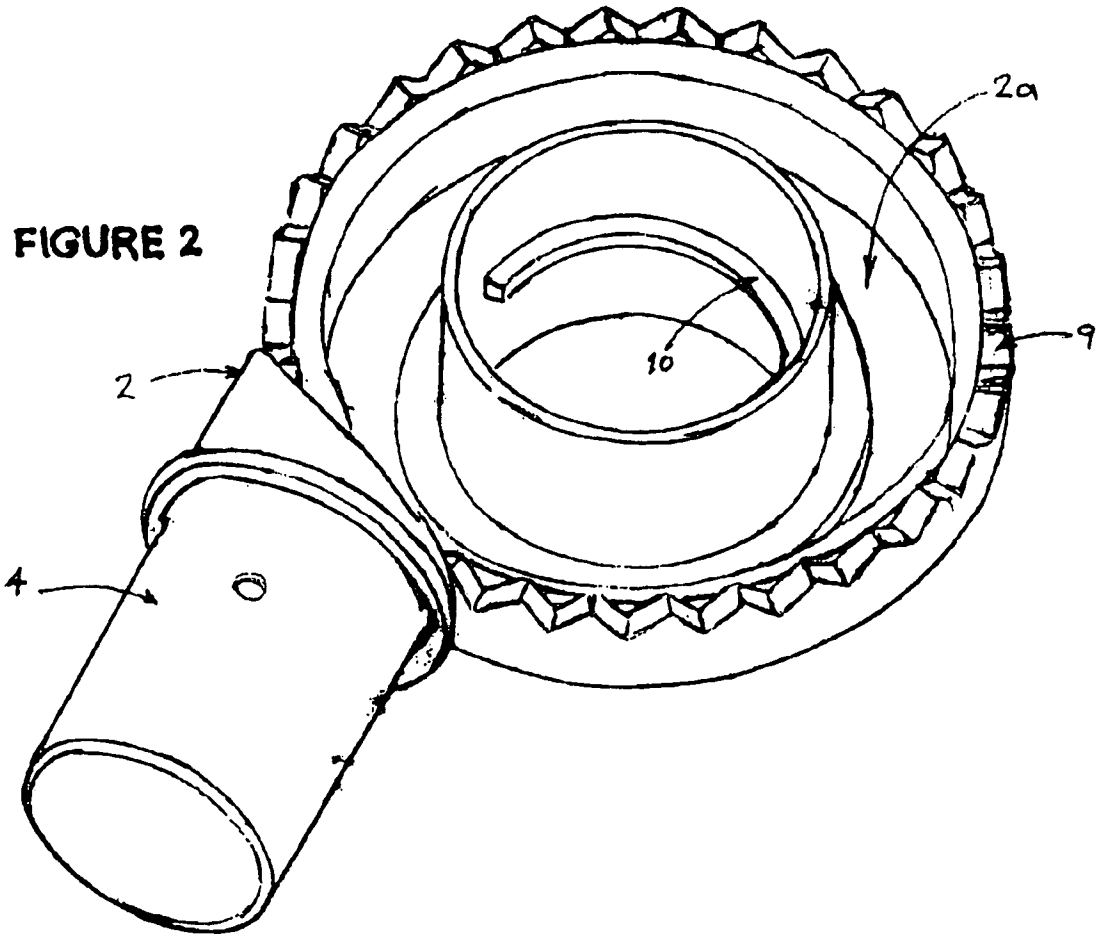
FIGS. 2, 3 & 4 show parts of the die cast knuckle.
Figure 3:
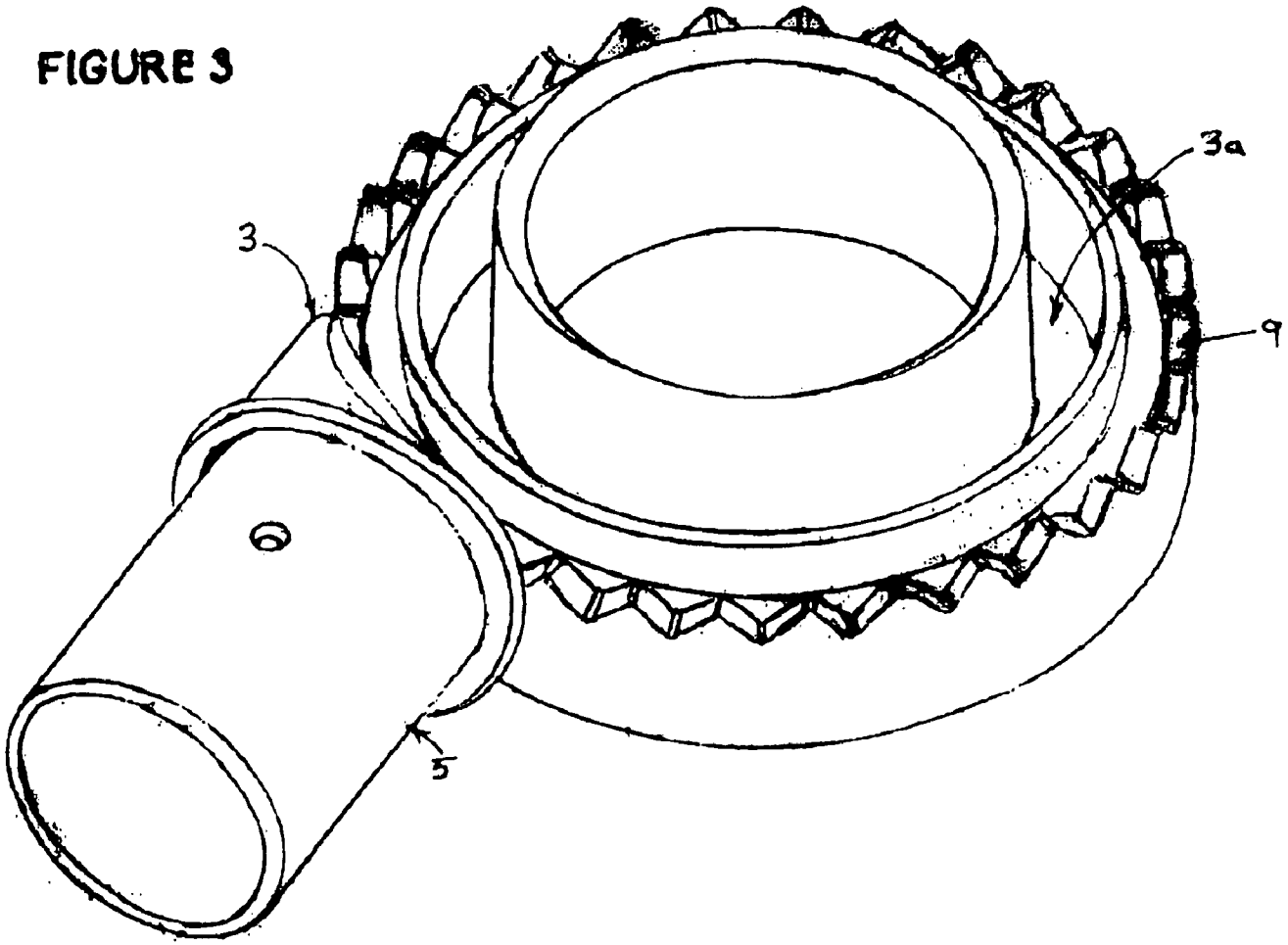

FIG. 2 shows the first portion 2 as it appears prior to assembly of the knuckle 1, and FIG. 3 shows a similar view of the second portion 3 prior to assembly. As shown in FIG. 2, the first portion 2 includes a threaded section 10 for receiving the bolt 8. The knuckle is arranged such that when it is in use water moves through channels 2*a* and 3*a* in the first and second portions respectively.

Figure 4:
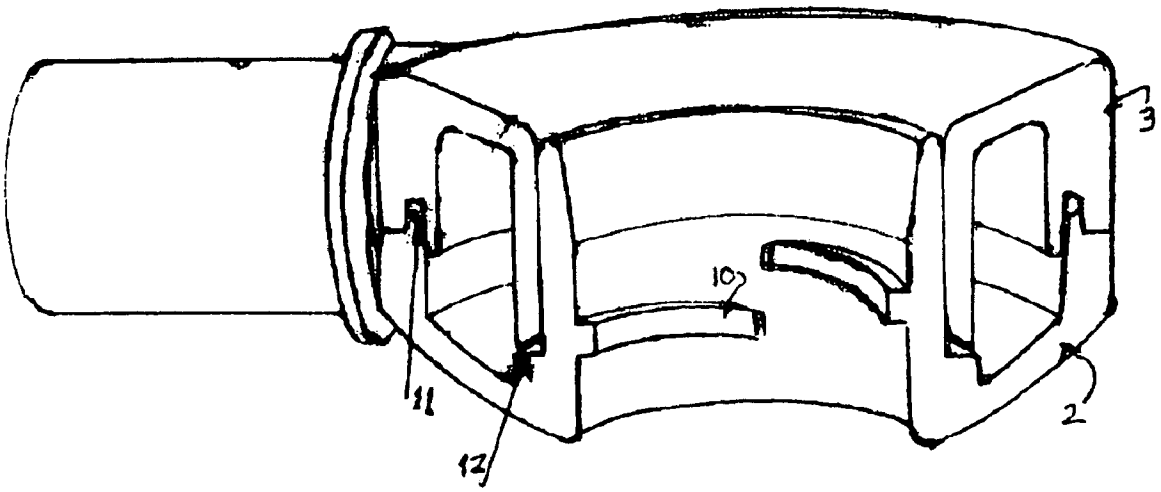

FIG. 4 shows internal parts of the knuckle 1, and in particular the way in which the first and second portions 2 and 3 combine. FIG. 4 also shows the positioning for outer and inner o-ring seals 11 and 12 respectively. Such seals serve to prevent undesirable leakage of water from within the knuckle 1 when it is in use.

Figure 5:
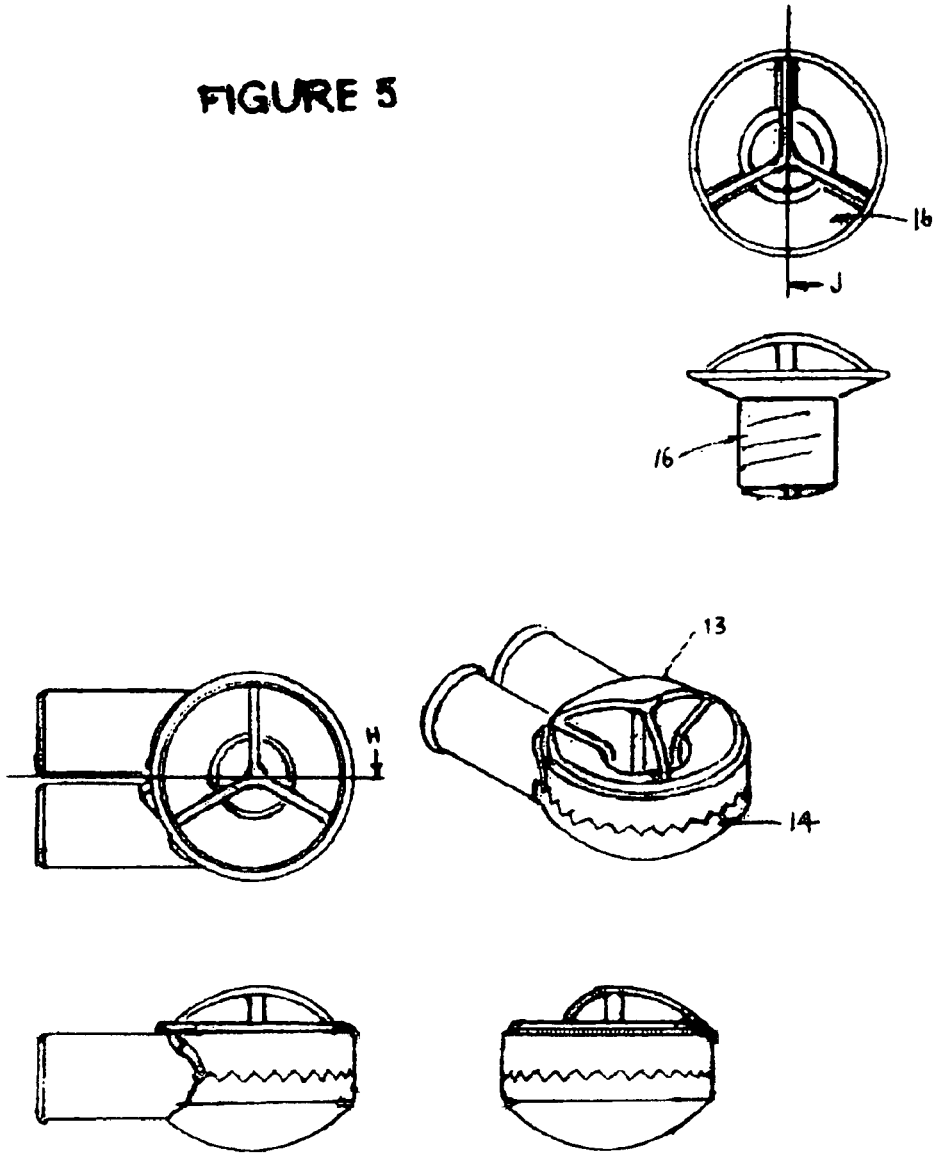
FIG. 5 shows various parts and views of a knuckle similar to that of FIGS. 1–4, and FIGS. 6 & 7 show various parts of a plastic knuckle for use as a connection between the handle of a boat hull cleaner and a cleaning head of the boat hull cleaner.

FIG. 5 shows various parts of a further embodiment of the invention, which is in the form of a plastic knuckle 13. The plastic knuckle is similar to the die-cast knuckle 1, having first and second portions 14 and 15, and a threaded locking/tightening bolt 16. The bolt 16 is associated with a suitable stop to prevent it from undesirably coming away from the rest of the plastic knuckle 13.

The first and second portions 14 and 15 are sealed with respect to one another to prevent undesired leakage of water from within the plastic knuckle 13 when it is in use. This is facilitated by way of flexible plastic seals which are forced into a tight fitting seal arrangement by way of water pressure within the plastic knuckle 13 when it is in use.

Figure 6:
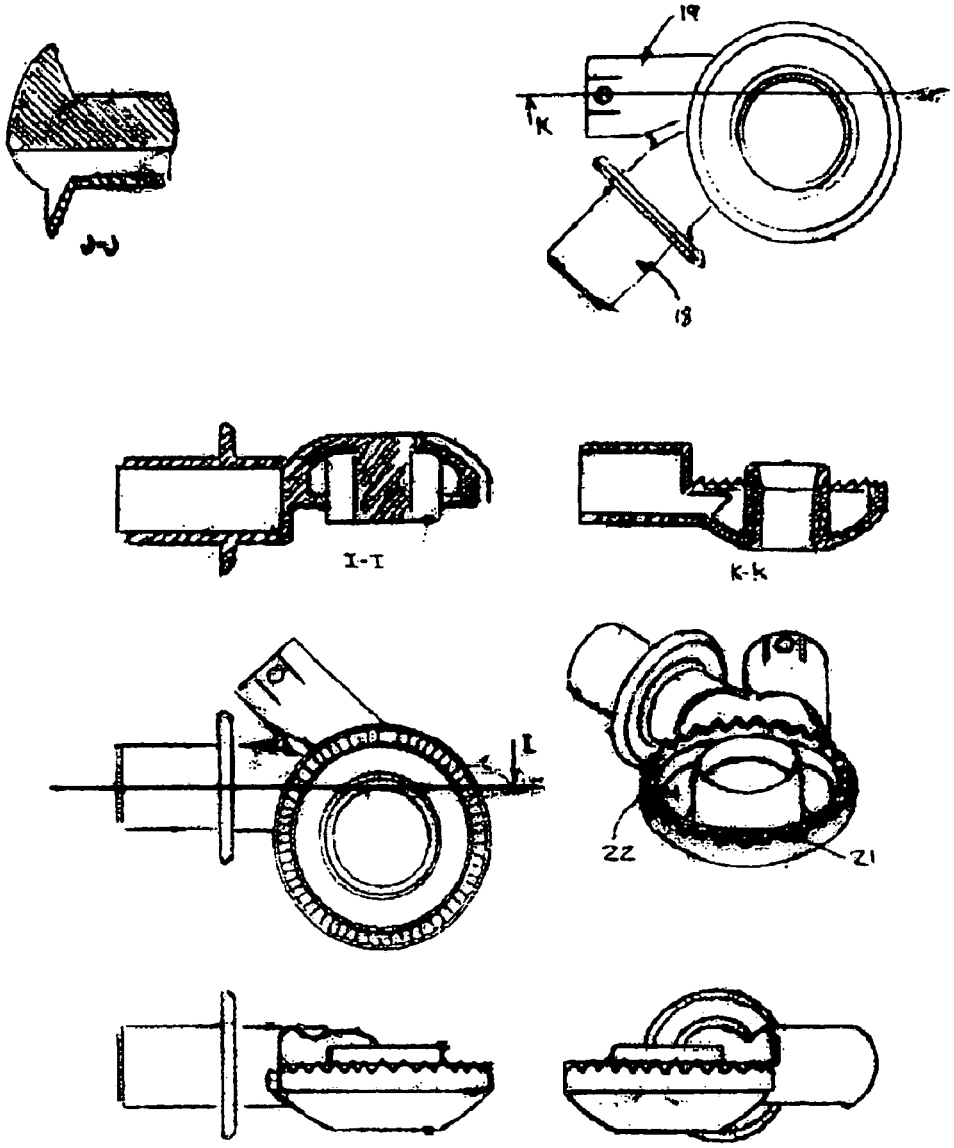
Figure 7:
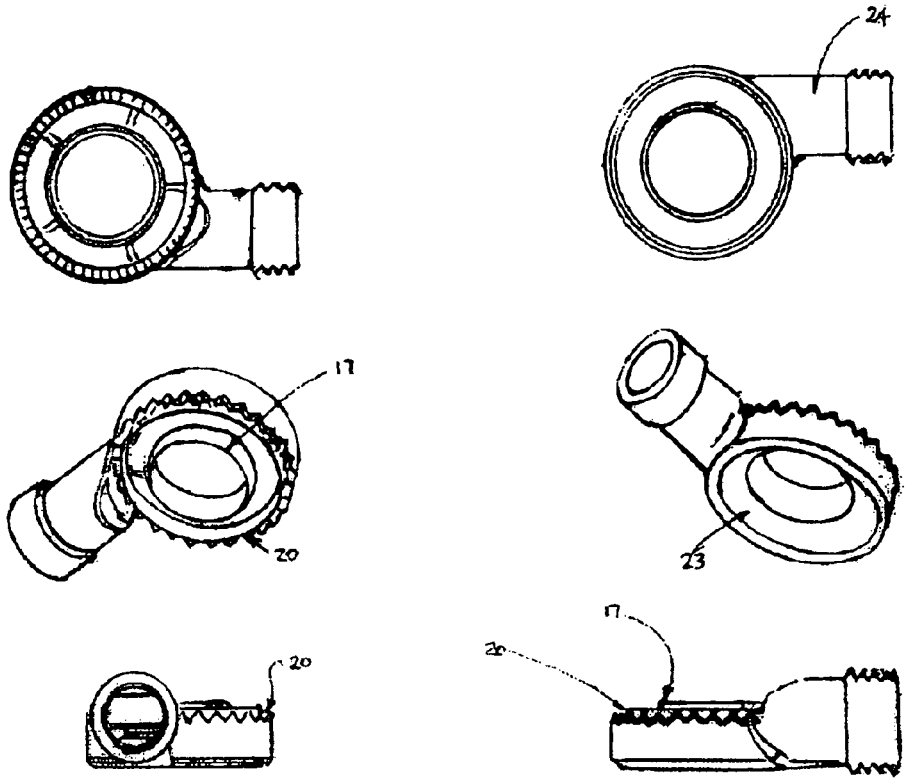
Figure 8:
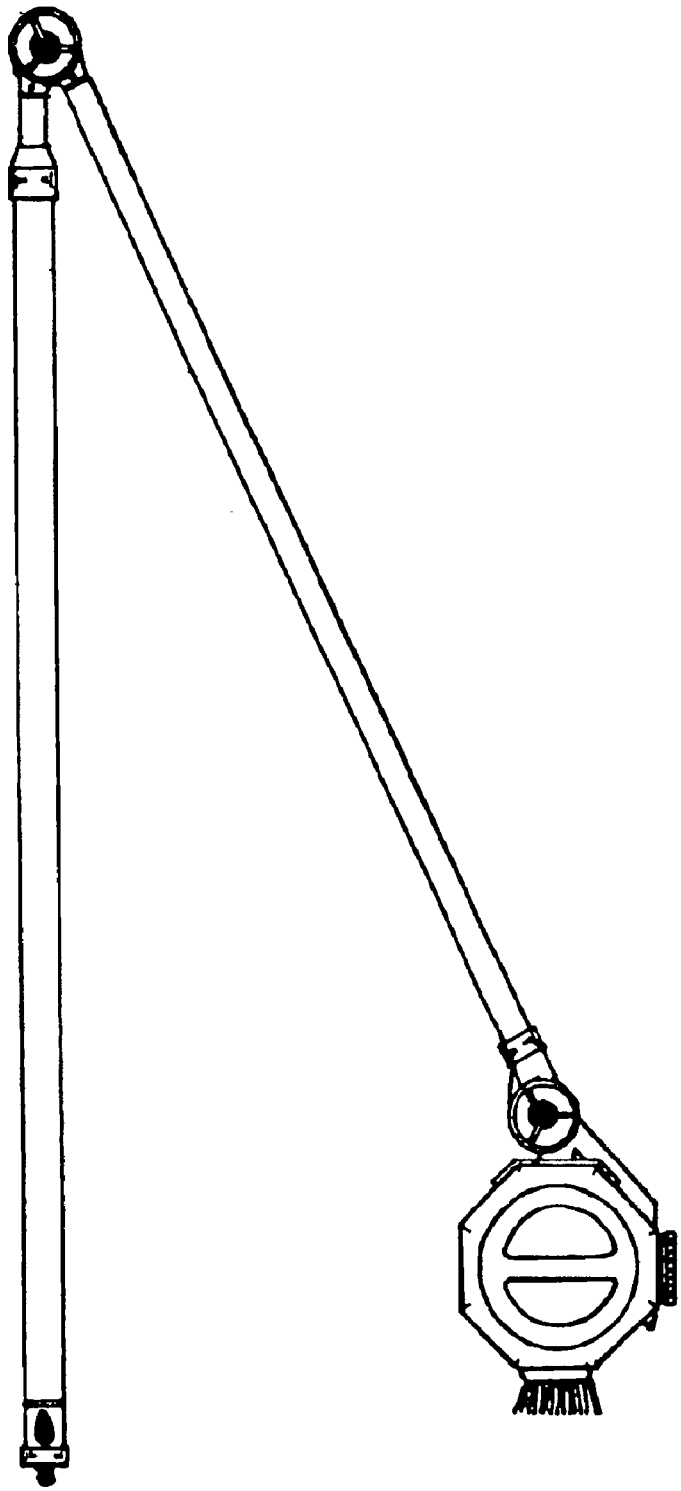
FIG. 8 shows the boat hull cleaner.

FIGS. 6 and 7 shows various parts of a further plastic knuckle for use at the end of the handle of a boat hull cleaner, the boat hull cleaner being similar to that described in U.S. Pat. No. 6,263,821 (Hodder). More specifically, this further knuckle provides an attachment between a pole like handle and a cleaning head of the boat hull cleaner.

More specifically, FIG. 6 shows half of a knuckle having a connector arm 18 for receiving a cleaning head (not shown) of the boat hull cleaner, and also shows a tubular outlet 19. FIG. 7 shows a further half of the knuckle, including a further connector arm 24 for receiving a lower part of a tubular handle (not shown) also forming part of the boat hull cleaner. When this embodiment of the invention is in use a flow of water can flow through the lower end of the handle, into the connector arm 24, into an internal channel of the knuckle, and can exit the knuckle via the tubular outlet 19. The tubular outlet 19 enables a jet of water to proceed adjacent the cleaning head to contact a boat hull, or to clean a brush forming part of the cleaning head, to facilitate the hull cleaning process. To facilitate the jet of water a water delivery attachment, for example a suitable nozzle, may be fitted to the tubular outlet 19. As indicated, the knuckle of this embodiment is arranged in two portions, one of which incorporates the connector arm 18 and the outlet 19, and the other of which incorporates the connector arm 24. The two portions can move (eg rotate) with respect to one another so that the angle between the handle and the cleaning head can be adjusted.

Referring to FIG. 7, the second mentioned half of the knuckle is complimentary to what is shown in FIG. 6, has an inner flexible plastic seal 17 and an outer flexible plastic seal 20. When the knuckle of this embodiment is assembled the inner flexible plastic seal 17 contacts a central annular mount 21 (see FIG. 6), and the outer flexible plastic seal 20 fits within an annular groove 22 (see FIG. 6), to prevent leakage of water from within the knuckle.

Referring to FIG. 7 there is shown a tapered surface 23 for receiving a locking bolt similar to that described with reference to FIG. 1.

While some preferred aspects of the invention have been described by way of example, it should be appreciated that modifications and improvements can occur without departing from the spirit and scope of the following claims.

What is claimed is:

1. A boat hull cleaner having a handle and a knuckle, the knuckle having a first portion and a second portion, the first portion having a first channel and the second portion having a second channel, the first portion having a first connector part joined to a first tubular part of the handle, and the second portion having a second connector part joined to a second tubular part of the handle;

the arrangement being such that a fluid can be caused to flow within the first tubular part of the handle, into the first and second channels of the knuckle, and then into the second tubular part of the handle, and wherein the first and second portions of the knuckle can be adjusted with respect to one another such that the first and second tubular parts of the handle assume with respect to one another;

the boat hull cleaner having a second knuckle at an end of the second tubular part of the handle remote from the first mentioned knuckle, the second knuckle arranged such that when it is in use fluid can flow from within the second tubular part of the handle to and through the second knuckle, into a cleaning head of the hull cleaner, and then exits the cleaning head; the cleaning head having at least one of a brush, a scourer, and a scraper; and wherein the second knuckle is angle adjustable to provide for angular adjustment between the second tubular part of the handle and the cleaning head.

2. A boat hull cleaner according to claim 1, wherein the first connector part forms at least part of a pipe-like arm for receiving the first tubular part of the handle, and/or the second connector part forms at least part of a further pipe like arm for receiving the second tubular part of the handle.

3. A boat hull cleaner according to claim 1, wherein the first portion of the knuckle is rotatable with respect to the second portion of the knuckle and wherein the first and second portions of the knuckle have teeth which can engage one another.

4. A boat hull cleaner according to claim 1, wherein at least one of the first and second portions of the knuckle has an o-ring seal arrangement to prevent undesired leakage of fluid from within the knuckle when the knuckle is in use with fluid flowing therethrough.

5. A boat hull cleaner according to claim 1, wherein the knuckle has a bolt which can be tightened to set the first and second connector parts at an angle with respect to one another, and then subsequently loosened to enable adjustment of the angle.

6. A boat hull cleaner having a handle and a knuckle, the knuckle having a first portion and a second portion, the first portion having a first channel and the second portion having a second channel, the first portion having a first pipe-like connector part joined to a first tubular part of the handle, and the second portion having a second pipe-like connector part joined to a second tubular part of the handle;

the first and second portions of the knuckle having teeth and rotatably engaging one another, seal means between the first and second portions of the knuckle to prevent undesired leakage of fluid from within the knuckle when fluid flows therethrough;

a locking device which can be tightened and loosened to enable the first and second connector parts of the knuckle, and thus the first and second tubular parts of the handle, to be set at various angles with respect to one another;

the arrangement being such that fluid can be caused to flow within the first tubular part of the handle, into the first and second channels of the knuckle, and then into the second tubular part of the handle;

the boat hull cleaner having a second knuckle at an end of the second tobular part of the handle remote from the first mentioned knuckle, the second knuckle arranged such that when it is in use fluid can flow within the second tubular part of the handle to and though the second knuckle, into a cleaning head of the hull cleaner, and then exist the cleaning head; and wherein the second knuckle is angle adjustable to provide for angular adjustment between the second tubular part of the handle and the cleaning head.

* * * * *